United States Patent [19]

Mochida

[11] 4,322,959

[45] Apr. 6, 1982

[54] LOCKING MEANS FOR A TRUNK IN AN AUTOMOBILE

[75] Inventor: Haruo Mochida, Yokohama, Japan

[73] Assignee: Nissan Motor Company, Limited, Kanagawa, Japan

[21] Appl. No.: 132,773

[22] Filed: Mar. 24, 1980

[30] Foreign Application Priority Data

Apr. 6, 1979 [JP] Japan ..... 54-46156[U]

[51] Int. Cl.[3] ..... E05B 47/04; E05B 65/19; E05B 65/36; H01H 27/06

[52] U.S. Cl. ..... 70/241; 70/239; 70/255; 70/263; 70/264; 70/279; 70/282; 200/61.64; 292/201; 292/DIG. 43

[58] Field of Search ..... 292/201, DIG. 43; 200/61.64, 61.66; 70/241, 240, 279, 282, 257, 255, 254, 283, 264, 263, 277, 239

[56] References Cited

U.S. PATENT DOCUMENTS

| | | | |
|---|---|---|---|
| 784,064 | 3/1905 | Nordenberg | 70/264 |
| 2,039,433 | 5/1936 | McNeill | 70/283 |
| 3,113,447 | 12/1963 | Oishei | 292/201 X |
| 3,200,623 | 8/1965 | Peters | 70/282 X |
| 3,744,285 | 7/1973 | Barmherzig | 70/283 X |
| 4,099,593 | 7/1978 | Schultz | 70/241 X |

FOREIGN PATENT DOCUMENTS

| | | | |
|---|---|---|---|
| 1801154 | 4/1970 | Fed. Rep. of Germany | 70/240 |

*Primary Examiner*—Roy D. Frazier
*Assistant Examiner*—Carl F. Pietruszka

[57] ABSTRACT

A locking means for a trunk in an automobile is disclosed which can be unlocked by the rotation of a key inserted in a key cylinder of the trunk and which comprises a first switch provided at a proper location in the room of the automobile to open and close a D.C. circuit including an actuator means for unlocking the locking means. A second switch which is usually closed is provided in said D.C. circuit in such a way as to be opened by the rotation of said key inserted in the key cylinder of the trunk in a direction contrary to that for unlocking the locking means, thereby it becomes possible for a proprietor of the automobile who stands outside the automobile near the trunk to actuate the second switch so as to prevent the opening of the trunk by any other person against the will of the proprietor.

4 Claims, 2 Drawing Figures

LOCKING MEANS FOR A TRUNK IN AN AUTOMOBILE

BACKGROUND OF THE INVENTION

The present invention relates to a locking means for a trunk in an automobile. More specifically, the invention relates to an improvement in a locking means for a trunk in an automobile of a type which can open the lock by the actuation of a first switch to energize an electric circuit including an actuator means for opening the lock and prevent the opening of the lock by any other person against the will of the proprietor of the automobile by the actuation of a second switch.

Conventionally, there has been known a locking means which is opened by the actuation of a switch provided at a proper location in a passenger room of an automobile to energize an actuator means such as solenoid, motor or the like. The locking means of this type is advantageous in that the lock is opened only by the operation of the switch which is provided in the passenger room of the automobile, however, it has a defect in that the trunk is not effectively prevented from being opened against the will of the proprietor of the automobile by any other person.

In view of such defect, there has also been known a means of a type to provide another switch in an electric circuit including the first mentioned switch, the actuator means for opening the lock and a D.C. power source and set the second mentioned switch at a proper location in the passenger room of the automobile, thereby preventing the opening of the trunk against the will of the proprietor of the automobile. In the means of this type, there has been proposed a system to provide the second switch in a glove compartment or a system to actuate the second switch by the rotation in the direction for locking of a key inserted in a key cylinder of the lid for glove compartment. In these systems, however, when the proprietor of the automobile who gets out of the automobile and stores or takes out the luggages or the like in the trunk and then the proprietor wants to actuate the second switch so as to prevent the opening of the trunk against the will of the proprietor by any other person, there occurs an inconvenience in that the proprietor must return to the passenger room in the automobile to actuate the second switch. In addition, there is such disadvantage in the latter system that the cost becomes high since the glove compartment must have a lid of a locking type.

SUMMARY OF THE INVENTION

With the above in mind, an object of the present invention is to provide a locking means for a trunk in an automobile which enables the proprietor of the automobile who gets out of the automobile and stands at the trunk position to do an operation to prevent the opening of the trunk against the will of the proprietor by any other person without returning to the passenger room of the automobile.

Another object of the present invention is to provide a locking means for a trunk in an automobile which is capable of lowering the cost in comparison with, for example, the conventional one having a locking-type lid for the glove compartment.

According to the present invention, there is provided a locking means for a trunk in an automobile which can be unlocked by the rotation of a key inserted in a key cylinder of the trunk and which comprises a first switch provided at a proper location in a passenger room of the automobile to open and close a D.C. circuit including an actuator means for unlocking the locking means characterized in that a second switch which is usually closed is provided in said D.C. circuit in such a way as to be opened by the rotation of said key inserted in the key cylinder of the trunk in a direction contrary to that for unlocking the locking means.

BRIEF DESCRIPTION OF THE DRAWINGS

The features and advantages of a locking means for a trunk in an automobile in accordance with the present invention will become apparent from the following description taken in conjunction with the accompanying drawings, in which.

In all the drawings, the same reference numeral indicates the same or a corresponding element.

DETAILED DESCRIPTION OF THE PRESENT INVENTION

Figure 1:
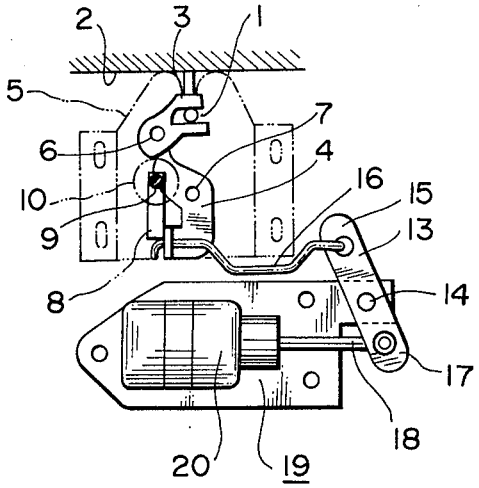
FIG. 1 is a front view of a locking means for a trunk in an automobile in accordance with the present invention.
Figure 2:
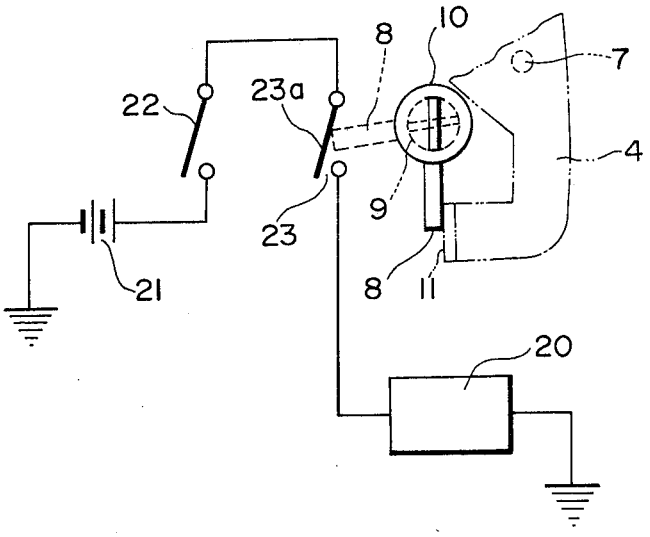
FIG. 2 is a schematic diagram of an electric circuit inclusive of a locking means for a trunk in an automobile shown in FIG. 1.

The present invention will now be described in terms of a preferred embodiment, and with reference to FIG. 1 and FIG. 2.

Reference numeral 1 denotes a substantially U-shaped striker which is mounted at the lower surface of the lid 2 of the trunk. A latch 3 which is adapted to engage the U-shaped striker 1 and a locking lever 4 which is adapted to engage the latch 3 are pivotally mounted respectively by means of pins 6 and 7 to a base plate 5 which is fixed to the vehicle body. The latch 3 and the locking lever 4 are energized respectively anti-clockwise and clockwise by means of springs (not shown).

As the lid 2 of the trunk is lowered from the position that the trunk is opened, the U-shaped striker 1 engages the latch 3 and rotates the same clockwise against the anti-clockwise tension of the spring. On this occasion, the upper end of the locking lever 4 which is energized clockwise by means of the spring engages the lower end of the latch 3 in such a way as to prevent the anti-clockwise rotation of the latch 3, thereby achieving the locking arrangement as shown in FIG. 1

On the other hand, a cylinder lever 8 is mounted to a rotation shaft 9 of a key cylinder 10 which is provided in the trunk body. In case a key is inserted in the key cylinder 10 and turned anti-clockwise, the cylinder lever 8 which is in contact with the lower end 11 of the locking lever 4 as shown in FIG. 2 rotates the locking lever 4 anti-clockwise around the pin 7 against the tension of the spring, thereby the upper end of the locking lever 4 gets out of the engagement with the lower end of the latch 3. At this time, the latch 3 which is freed from the engagement with the locking lever 4 rotates anti-clockwise around the pin 6 by the tension of the spring provided thereto so as to free the U-shaped striker 1 from the engagement with the latch 3, thereby the locking between the lid 2 and the vehicle body becomes unlocked.

In addition to such manual operation of the key inserted in the key cylinder 10, the unlocking operation of the trunk can also be done by electromagnetic driving means as mentioned below.

That is, reference numeral 13 denotes a swing lever which is pivotally supported by means of a pin 14. One end 15 of this swing lever 13 is connected to the lower end of the locking lever 4 via a connecting rod 16 and the other end 17 of the swing lever 13 is connected to the end of a rod 18 of a plunger mechanism 19. Reference numeral 20 denotes a driving means such as a D.C. motor, a solenoid or the like for effecting the plunging motion of the rod 18 of the plunger mechanism 19. A D.C. power source 21, a first switch 22 which is usually opened, a second switch 23 which is usually closed and the driving means 20 for the plunger mechanism 19 are connected in series as shown in FIG. 2.

The first switch 22 is set at a proper location in the passenger room of the automobile, preferably in the vicinity of the front seat. When the first switch 22 is closed, an electric current flows from the plus terminal of the D.C. power source 21 through the first switch 22, the second switch 23 which is usually closed and the driving means 20 for the plunger mechanism 19 to the earth, thereby energizing the plunger mechanism 19 and contracting the rod 18 thereof so as to rotate the swing lever 13 clockwise around the pin 14. Accordingly, the connecting rod 16 is pulled in the direction to rotate the locking lever 4 anti-clockwise around the pin 7 so as to free the upper end of the locking lever 4 from the engagement with the lower end of the latch 3. In such a way, the unlocking operation can be done by the actuation of the first switch 22 which is set at a proper location in the passenger room of the automobile, preferably in the vicinity of the front seat, in addition to the manual operation of the key inserted in the key cylinder 10 as mentioned before.

What is characteristic of this embodiment resides in the relative arrangement between the contact **23*a* of the second switch 23 which is usually closed and the cylinder lever 8 which is mounted to the rotation shaft 9 of the key cylinder 10. That is, the cylinder lever 8 of the key cylinder 10 is positioned in such a way as to become in contact with and open the contact 23*a* of the second switch 23 which is usually closed when the key is inserted in the key cylinder 10 and the cylinder lever 8 is turned by a predetermined angle in the direction contrary to that for opening the locking as mentioned above (clockwise in FIG. 2**) to the position indicated by the dotted line.

Therefore, in case the proprietor of the automobile gets out of the automobile, opens the lid 2 of the trunk by the manual operation of the key inserted in the key cylinder 10 or the actuation of the first switch 22 as mentioned above, stores or takes out the luggages or the like in the trunk and closes the lid 2 and then the proprietor wishes to prevent the opening of the trunk by any other person against the will of the proprietor, he need only turn the key inserted in the key cylinder 10 in the direction contrary to that for opening the locking (clockwise in the drawing) at the place. On this occasion, it is not necessary for the proprietor to return to the passenger room in the automobile as in the conventional means. In this case, the key is pulled out from the key cylinder 10 at the position indicated by the dotted line in FIG. 2

After the second switch 23 is opened by the cylinder lever 8 as mentioned above, the electric circuit including the driving means 20 for the plunger mechanism 19 is not energized even if the first switch 22 which is set at the proper location in the passenger room of the automobile is closed. Therefore, the opening of the trunk by any other person against the will of the proprietor of the automobile can be perfectly prohibited.

Then, in case the proprietor again wishes to open the trunk, he may insert the key in the key cylinder 10 and turn the same so that the cylinder lever 8 may return from the position indicated by the dotted line to the position indicated by the solid line. By so doing, the second switch 22 is again closed. Thereafter, the trunk can be opened either by the manual operation of the key inserted in the key cylinder 10 in the direction to push the locking lever 4 anti-clockwise or by the actuation of the first switch 22 which is set at the proper location in the passenger room of the automobile as mentioned above.

As will be clear from the foregoing description, a locking means for a trunk in an automobile in accordance with the present invention is constituted in such a way that a contact **23*a* of a second switch 23 in an electric circuit including an actuator means 19 for opening the locking is opened by the rotation of the key or the cylinder lever 8 mounted to the key cylinder 10** in the direction contrary to that for opening the locking. Thus, it becomes possible for the proprietor of the automobile who gets out of the automobile and stands at the trunk position to conveniently do the operation to prevent the opening of the trunk by any other person against the will of the proprietor without returning to the front seat in the passenger room of the automobile.

Further, the locking means for a trunk in an automobile in accordance with the present invention can be achieved utilizing the conventionally available means including the first and second switches, thereby lowering the cost, for example, in comparison with the conventional one having a locking-type lid for the glove compartment.

While the present invention has been described in terms of a preferred embodiment, and with reference to the drawings, this is not to be taken as limitative of the present invention which is rather to be defined by the appended claims. In particular, the direction to rotate the key for locking and unlocking or the mounting position or type of the locking means may be varied to suit the particular applications.

What is claimed is:

1. In a locking means for a trunk in an automobile which can be unlocked by the rotation of a key inserted in a key cylinder of the trunk and which comprises a first switch provided at a proper location in a passenger room of the automobile to open and close a D.C. circuit including an actuator means for unlocking the locking means, the improvement wherein a second switch which is usually closed is provided in said D.C. circuit in such a way as to be opened by the rotation of said key inserted in the key cylinder of the trunk in a direction contrary to that for unlocking the locking means.

2. A locking means for a trunk in an automobile as claimed in claim 1 wherein said actuator means includes a plunger mechanism.

3. A locking means for a trunk in an automobile as claimed in claim 2 wherein said plunger mechanism includes a D.C. motor.

4. A locking means for a trunk in an automobile as claimed in claim 3 wherein said key cylinder of the trunk has a cylinder lever connected thereto to open the contact of said second switch which is usually closed.

* * * * *